US007887397B2

(12) United States Patent
Shen

(10) Patent No.: US 7,887,397 B2
(45) Date of Patent: Feb. 15, 2011

(54) KNIFE SHARPENING BAR

(76) Inventor: Cheng-Hsien Shen, No. 196, Yi-an St., Annan District, Tainan City 70951 (TW)

( * ) Notice: Subject to any disclaimer, the term of this patent is extended or adjusted under 35 U.S.C. 154(b) by 555 days.

(21) Appl. No.: 12/015,525

(22) Filed: Jan. 17, 2008

(65) Prior Publication Data

US 2009/0183601 A1 Jul. 23, 2009

(51) Int. Cl.
*B24B 3/54* (2006.01)

(52) U.S. Cl. ..... 451/552; 76/84; 451/553; 451/557

(58) Field of Classification Search ..... 451/552, 451/553, 556, 557, 558; 76/84
See application file for complete search history.

(56) References Cited

U.S. PATENT DOCUMENTS 953,445 A * 3/1910 Stephan ..... 451/557
1,158,048 A * 10/1915 Hawks ..... 76/88
2,379,569 A * 7/1945 Ellis ..... 451/557
3,861,087 A * 1/1975 Martin ..... 76/84
6,048,262 A * 4/2000 Ray ..... 451/555
6,371,841 B1 * 4/2002 Ray ..... 451/523
6,540,582 B1 * 4/2003 Primos et al. ..... 451/525
7,713,112 B2 * 5/2010 Huang ..... 451/525

* cited by examiner

*Primary Examiner*—Maurina Rachuba
(74) *Attorney, Agent, or Firm*—Leong C. Lei

(57) ABSTRACT

A knife sharpening bar includes a handle that carries a support bar. A flexible tube is tightly fit over the support bar. A hollow ceramic bar is then fit over the flexible tube with an inside surface of the ceramic bar tightly engaging the flexible tube so that the flexible tube provides a cushioning support between the support bar and the ceramic bar, which protects the ceramic bar from directly bearing any external impact applied to the knife sharpening bar. An internally-threaded cap engages an externally-threaded free end of the support bar and abuts against the ceramic bar to thereby secure the ceramic bar in position on the support bar. Collars or other buffering members can be positioned at opposite ends of the ceramic bar.

4 Claims, 5 Drawing Sheets

KNIFE SHARPENING BAR

BACKGROUND OF THE INVENTION (a) Technical Field of the Invention

The present invention relates to an improvement on ceramic knife sharpener, wherein a conventionally used solid ceramic bar is replaced with a hollow tubular ceramic bar and a support bar that has an outside diameter smaller than an inside diameter of the hollow ceramic bar is extended from a handle with a flexible tube being tightly fit over the support bar, and wherein when the hollow ceramic bar is to be fit over the flexible tube that is fit on the support bar, two collars, which are also fit over the support bar, are provided on opposite ends of the ceramic bar and an internally-threaded cap threadedly attached to the support bar to securely hold the ceramic bar to the support bar whereby when the knife sharpener is subjected to an impact force, the energy of impact is absorbed by the flexible tube and the collars to protect the ceramic bar from being broken.

(b) Description of the Prior Art

A conventional bar sharpener for knives is shown in FIG. 1 and broadly designated at 1, comprising a handle 11 having an end to which a sharpening bar 12 is mounted. The sharpening bar 12 is made of metals, such as stainless steel. Although the sharpening bar 12 is made of a material having a high hardness, it, after a substantial time of use, forms clear scrapes thereon by the knives sharpened by the sharpener. Further, since the knives to be sharpened by the sharpener may be made of a material having hardness similar to that of the sharpener, effective sharpening of the knives may not be realized. Another knife sharpener bar, which is shown in FIG. 2 and broadly designated at 2, also comprises a handle 21 having an end to which a ceramic bar 22 is mounted. The ceramic bar 22 is of a lighter weight as compared to the metal-made sharpening bar 12 and has hardness greater than that of the metal-made sharpening bar 12 and thus, improved sharpening result can be obtained. In other words, the knives can be made more sharpened in an easier and more effective manner with enhanced operation smoothness and convenience. However, the ceramic knife sharpener suffers a major drawback. For the general use of the knife sharpener, it is usually positioned in a location that is easily accessed by a user, which often causes the knife sharpener that is of a round configuration to fall off a corner or an edge of a fixture or a work table and hit the ground. For the metal-made knife sharpeners, hitting the ground does not cause serious damage to the sharpening bar, but for a ceramic sharpener, since the ceramic material is generally fragile, undesired impact, such as hitting the ground, may simply break the ceramic bar, totally destructing the knife sharpener.

Thus, it is desired to provide a knife sharpening device flat overcomes the above drawbacks.

SUMMARY OF THE INVENTION

The primary purpose of the present invention is to provide an improved structure of a knife sharpening bar, which has a structure of a combination of separate parts and which provides a new design for the knife sharpening bar that is capable to provide cushioning against external impacts, wherein a hollow ceramic bar replaces a conventionally used solid ceramic bar and a support bar that has an outside diameter smaller than an inside diameter of the hollow ceramic bar is extended from a handle with a flexible tube being tightly fit over the support bar. When the hollow ceramic bar is fit over the support bar, the flexible tube tightly engages an inside surface of the ceramic bar to secure the ceramic bar and the support bar together as a unitary member. Two collars, which are also fit over the support bar, are provided on opposite ends of the ceramic bar and are secured by threaded fastening realized by a cap. Thus, when the knife sharpening bar is inadvertently dropped to the ground, the impact caused by hitting the ground can be almost absorbed by the flexible tube and the collars and the ceramic bar is subjected only an extremely small portion of the impact to thereby protect the ceramic bar from being easily broken and extending the lifespan thereof.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
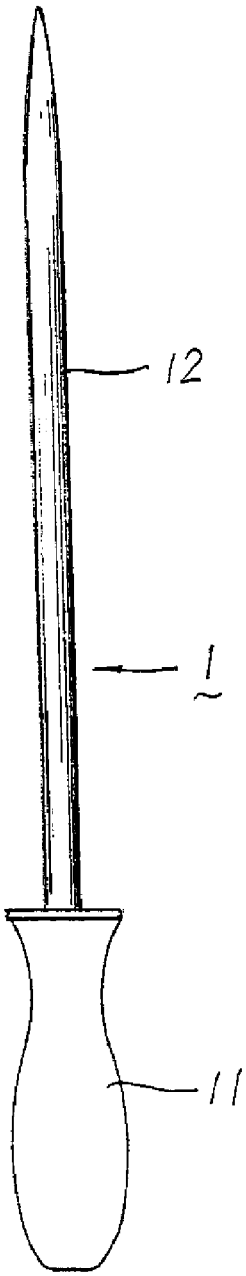
PRIOR ART FIG . 1
FIG. 1 is a side elevational view of a conventional knife sharpening bar.
Figure 2:
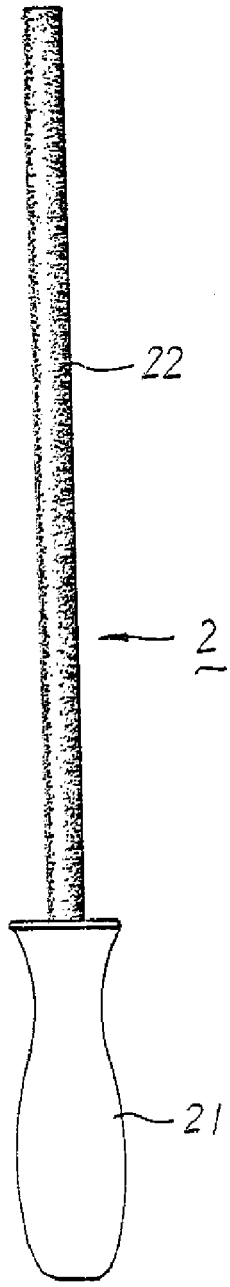
FIG. 2 is a side elevational view of another conventional knife sharpening bar.
Figure 3:
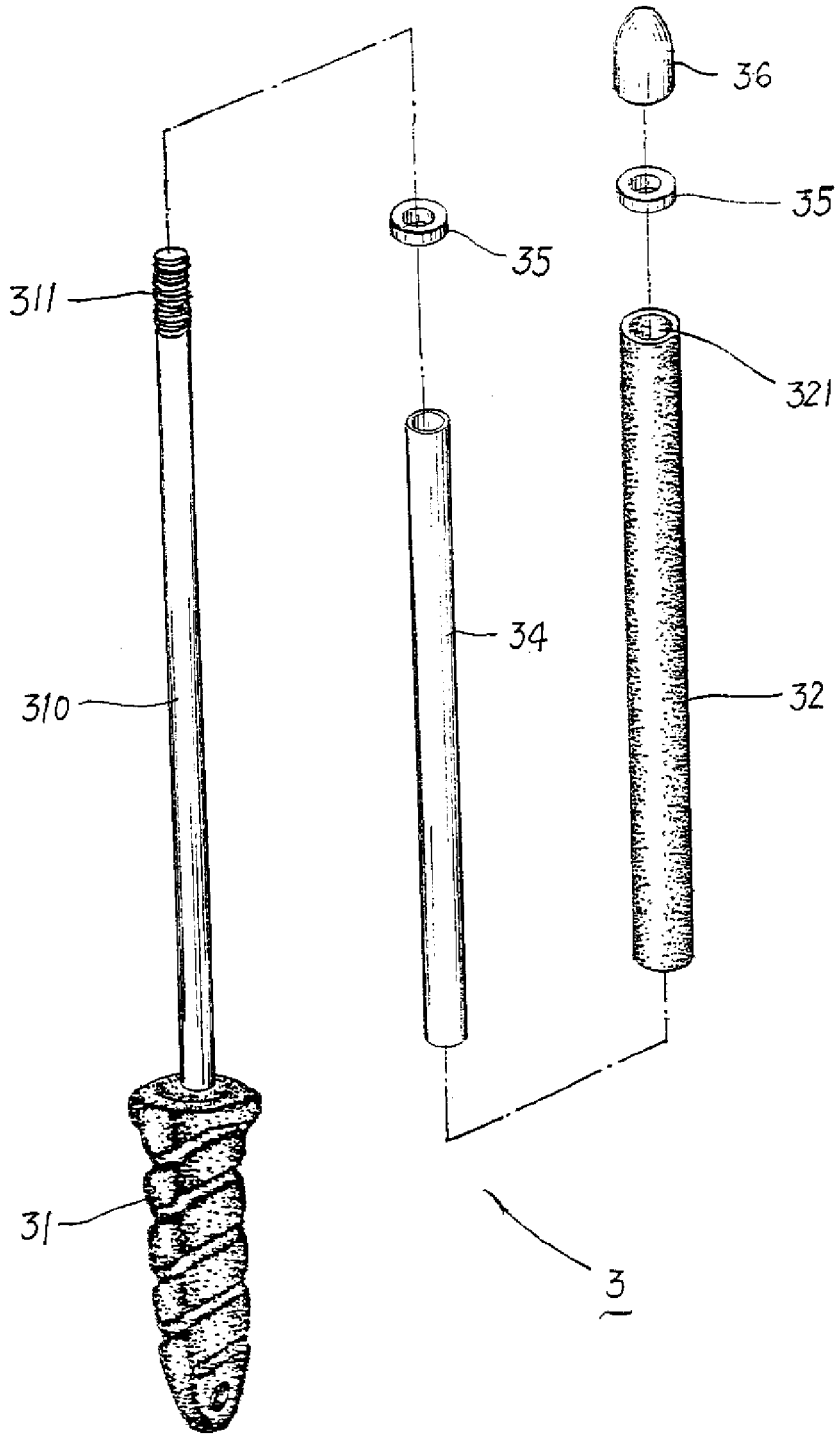
FIG. 3 is an exploded view of a knife sharpening bar constructed in accordance with an embodiment of the present invention.
Figure 4:
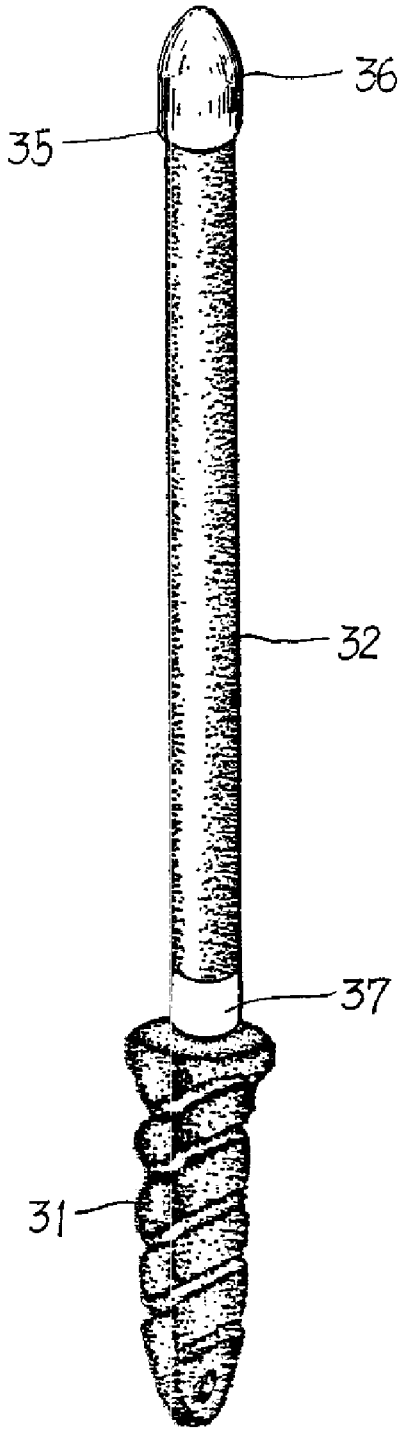
FIG. 4 is a perspective view of the knife sharpening bar of the present invention.
Figure 5:
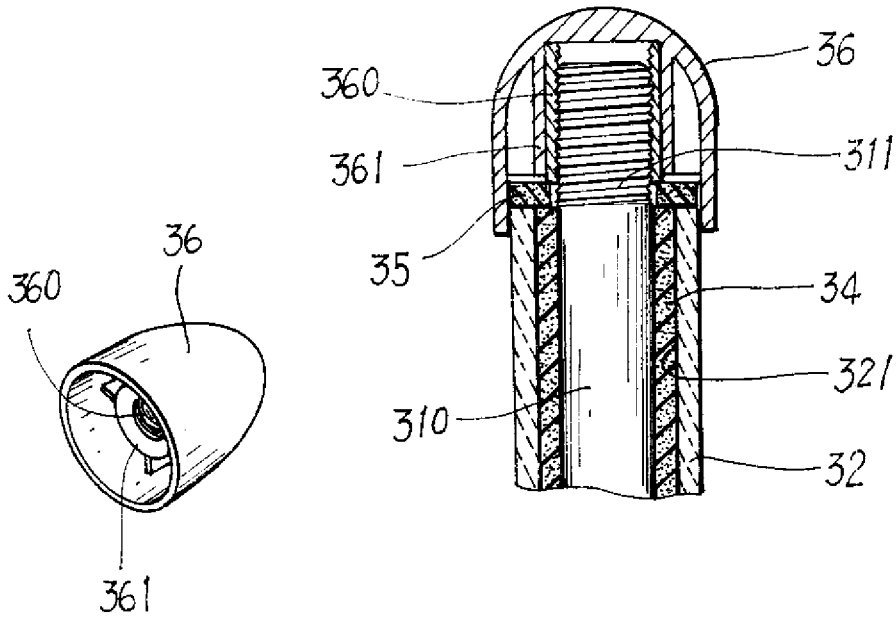
FIG. 5 is a cross-sectional view of a distal end portion of the knife sharpening bar illustrating details of a cap that secures a ceramic bar to a support bar of the knife sharpening bar of the present invention.

With reference to the drawings, and in particular to FIG. 3, a knife sharpening bar constructed in accordance with the present invention, generally designated with reference numeral 3, comprises a handle 31 and a ceramic bar 32. The handle 31 forms, on an inner end thereof an elongate support bar 310 that extends from the inner end of the handle 31 to a distal free end, which forms an external thread 311. A flexible tube 34 is tightly fit over the support bar 310 so as to encompass the support bar 310. The ceramic bar 32 is of a tubular structure having a central bore 321 that is fit over the flexible tube 34 to be supported by the support bar 310. Two cushioning collars 35 are also fit over the support bar 310 and arranged on opposite ends of the ceramic bar 32. A cap 36 is fixed to the free end of the support bar 310 to secure the ceramic bar 32. As shown in FIGS. 3-5, to assemble, one of the collars 35 is first fit over the support bar 310 and is moved to the bottom or proximal end of the support bar 310 where the support bar 310 joints to the handle 31. The flexible tube 34 is then fit over the support bar 310 and then the ceramic bar 32 is fit over the flexible tube 34 with the bore 321 thereof and retained on the collar 35. The bore 321 is sized to have the flexible tube 34 tightly engaging an inner surface of the bore 321 of the ceramic tube 32. The thread 311 of the support bar 310 projects beyond the ceramic bar 32. The other collar 35 is then fit over the support bar 310. Finally, the cap 36 is capped on the free end of the support bar 310 by having a nut 360 fixed therein engaging the thread 311 of the support bar 310. The cap 36 also forms therein a positioning member 361 that is engageable with the collar 35 when the cap 36 is threadedly fixed to the support bar 310 whereby the ceramic bar 32 is securely held between the collars 35 on the support bar 310. The threading engagement between the cap 36 and the thread 311 of the support bar 310 fixes the cap 36 to the support bar 310 and makes the cap 36 and the ceramic bar 32 securely fixed together as a unitary member. Preferably the cap 36 has an inside diameter greater than the outside diameter of the ceramic bar 32 so that a lower opening of the cap 36 may fit over the distal free end of the ceramic bar 32.

The use of the knife sharpening bar 3 is similar to that of the conventional knife sharpening bar 2 that has been described previously. However, as shown in FIG. 4, the ceramic bar 32 is supported on the support bar 310 by being securely retained in position by the collars 35 on opposite ends thereof so that when the knife sharpening bar of the present invention is subjected to impact either on the handle 31 or the cap 36, the impact will not be directly applied to the ceramic bar 32 and in stead, the impact is transmitted through the support bar 310 to the ceramic bar 32. Thus, the ceramic bar 32, due to being retained in position by abutting against the collars 35 on opposite sides thereof and the flexible tube 34 that engages inside surface of the ceramic bar 32, is protected from the impact by the cushioning effect realized by the collars 35 and the flexible tube 34, which absorb most of the energy of the impact. Consequently, the ceramic bar 32 is not easily broken. If desired, an indication ring 37 can be fit over a lower portion of the ceramic bar 32 that is close to the handle 31 for indication or identification purposes.

The flexible tube 34 is constructed as a hollow tube sized to tightly fit over the support bar 310 or is integrally formed on the support bar 310. Thus, when the ceramic bar 32 is fit over the support bar 310, the flexible tube 34 is tightly engageable with the inside surface of the ceramic bar 32 and is thus tightly interposed between the ceramic bar 32 and the support bar 310 toe provide cushioning effect therebetween when the knife sharpening bar is subjected to external impacts to absorb most of the impact energy and thus protect the ceramic bar 32 from the impact. Consequently, the disadvantage of the conventional ceramic bar sharpener of being easy to break due to fragility thereof can be effectively obviated.

Figure 6:
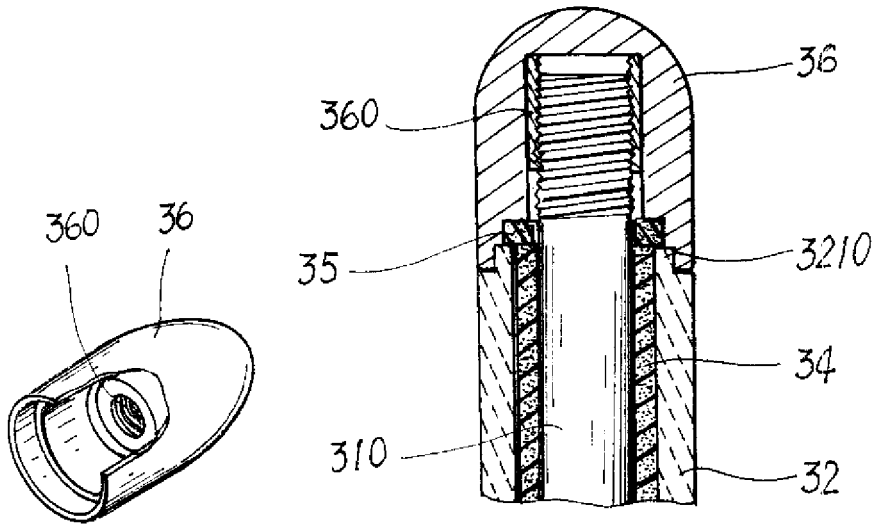
FIG. 6 is a cross-sectional view of a distal end portion of a knife sharpening bar constructed in accordance with another embodiment of the present invention, illustrating details of a cap that secures a ceramic bar to a support bar of the knife sharpening bar of the present invention.
Figure 7:
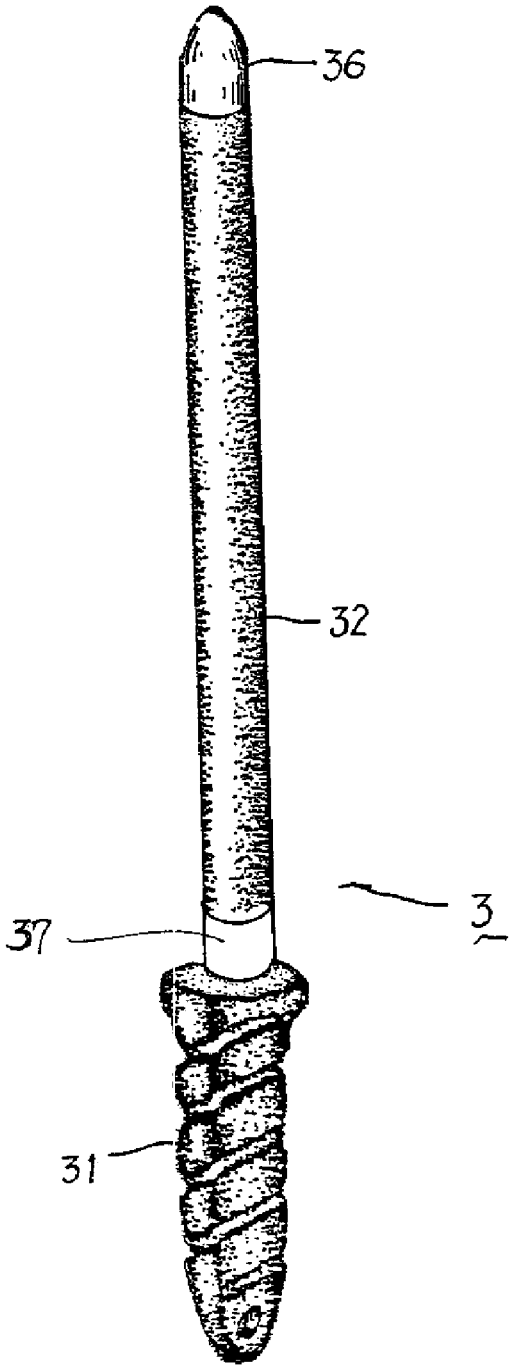
FIG. 7 is a perspective view of the knife sharpening bar of said another embodiment of the present invention.

Next, referring to FIG. 6, which shows a cross-sectional view of another embodiment of the knife sharpening bar in accordance with the present invention, in his embodiment, the distal end of the ceramic bar 32 forms a diameter reduced end portion 3210. When the ceramic bar 32 is assembled to the support bar 310, the outer collar 35 that is subsequently fit over the support bar 310 is positioned on the reduced end portion 3210 and the cap 36, when threadedly capped to the threaded end of the support bar 310 is partially fit over and thus enclose the reduced end 3210 and forms an outer circumferential surface that is flush with and continuous with an outer circumferential surface of the ceramic bar 32. With the cap 36 threadedly fixed to the support bar 310, the outer collar 35 securely holds the ceramic bar 32 to provide cushioning to the ceramic bar 32 when the knife sharpening bar 3 is subjected to any impact. Thus, the drawback of the conventional bar sharpener of being easy to break by external impact can be improved. Similar to the previous embodiment, an indication ring 37 can be fit over a lower portion of the ceramic bar 32 that is close to the handle 31 for easy identification and indication.

Although not complicated in construction, the knife sharpening bar of the present invention is effective in providing cushioning to the ceramic bar by means of the flexible tube, as well as the collars, that absorbs most of the impact energy applied to the knife sharpening bar so that the ceramic bar is protected from being easily broken and the lifespan is extended to thereby reduce the costs for purchasing knife sharpener.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A knife sharpening device comprising:

a handle;

a support bar extended from an end of said handle;

a flexible tube fitted over said support bar;

a ceramic bar which is of a tubular structure having a central bore fitted over said flexible tube; and a cap fixed to a free end of said support bar to secure said ceramic bar.

2. The knife sharpening device as claimed in claim 1, further comprising two cushioning collars fitted over said support bar and arranged on opposite ends of said ceramic bar.

3. The knife sharpening device as claimed in claim 1, wherein said ceramic bar has a free end that is remote from said handle and provided with a reduced end section.

4. The knife sharpening device as claimed in claim 1, wherein said free end of said support bar is provided with external threads engageable with internal threaded of said cap.

* * * * *